United States Patent [19]

Münchinger et al.

[11] 4,229,928

[45] Oct. 28, 1980

[54] METHOD OF AND AN APPARATUS FOR PACKAGING CONSUMER GOODS

[76] Inventors: Bernd Münchinger, Talstrasse 9, 7064 Remshalden 1; Robert Brehm, Schmölzstrasse 11, 8104 Grainau, both of Fed. Rep. of Germany

[21] Appl. No.: 846,521

[22] Filed: Oct. 28, 1977

[30] Foreign Application Priority Data

| | | | |
|---|---|---|---|
| Oct. 29, 1976 | [DE] | Fed. Rep. of Germany | 2649777 |
| May 23, 1977 | [DE] | Fed. Rep. of Germany | 2723173 |
| Aug. 1, 1977 | [DE] | Fed. Rep. of Germany | 2734644 |

[51] Int. Cl.[2] ..... B65B 43/06

[52] U.S. Cl. ..... 53/452; 53/459; 53/469; 53/558; 53/570

[58] Field of Search ..... 53/452, 455, 459, 469, 53/558, 562, 570

[56] References Cited

U.S. PATENT DOCUMENTS

| | | | |
|---|---|---|---|
| 3,445,982 | 5/1969 | Schweikert | 53/452 |
| 3,446,334 | 5/1969 | Donner | 198/417 |
| 3,543,466 | 12/1970 | Forsberg | 53/459 |
| 3,599,388 | 8/1971 | Feingold | 53/459 |
| 3,746,056 | 7/1973 | Titchenal | 53/570 X |

*Primary Examiner*—Travis S. McGehee

*Attorney, Agent, or Firm*—Michael J. Striker

[57] ABSTRACT

Two superimposed layers of thermally weldable material are welded to one another at welding zones delimiting respective receptacle preforms having respective open ends and connected in series to a transporting strip which extends longitudinally of the processing path of displacement of the receptacle preforms. The goods to be packaged are introduced into the respective receptacle after the two layers of the respective receptacle preform have been separated by blowing a stream of air into the receptacle through the open end thereof. Thereafter, the open end of the receptacle preform is closed and the receptacle preform is severed from the transporting strip to obtain a filled receptacle which is freely transportable. The welding operation is performed by a welding roller which has an electrically resistive conductor wire mounted thereon along such a course that, when developed into the plane of the superimposed layers, the conductor wire will coincide with the zones to be welded. A severing arrangement which cuts through the superimposed layers to obtain openings in the receptacles is displaced by an eccentric portion of the welding roller in a predetermined sequence with the welding operation.

17 Claims, 6 Drawing Figures

METHOD OF AND AN APPARATUS FOR PACKAGING CONSUMER GOODS

BACKGROUND OF THE INVENTION

The present invention relates to a method of and an apparatus for packaging goods in general, and more particularly to packaging consumer goods at retail establishments and the like.

It is well known that, for instance, in retail establishments, consumer goods are to be wrapped or otherwise accommodated in receptacles, such as bags, boxes nd the like, unless the consumer goods already reach the retail establishment in a packaged condition, and in many instances even under these circumstances. It is also well known that the shape of the packaging receptacles for accommodating the consumer goods rarely, if ever, conforms to the shape of the goods to be packaged so that larger than necessary packaging receptacles have to be used in such establishments in order to be able to accommodate the goods to be packaged therein. This, of course, involves unnecessary waste of valuable material and, as a concomitant thereof, also an unnecessary additional expenditure. Also, the appearance of the conventional packaging receptacles, such as paper bags, leaves much to be desired and detracts from the aesthetic appeal of the goods packaged therein, which may be of importance in some circumstances. On the other hand, if the consumer goods reach the retail establishment already in a prepackaged condition, it is by no means certain that the prepackaged quantity is exactly what the consumer wants so that, in some instances, the original packages have to be opened, and the desired quantity of the goods transferred therefrom into different packaging receptacles. Then, the same problems as those ennumerated above are encountered. It may be seen from the above that the state of the packaging procedure, particularly at the retail level, leaves much to be desired.

SUMMARY OF THE INVENTION

Accordingly, it is a general object of the present invention to avoid the disadvantages of the prior art.

More particularly, it is an object of the present invention to device a method of packaging consumer goods which can be performed simply and inexpensively, for instance, at a retail establishment.

Yet more particularly, it is an object of the present invention to develop a packaging method which can be performed inexpensively and in a rapid and semi-automatic manner.

A concomitant object of the present invention is to design an apparatus for performing the above method which is simple in construction, easy to operate, inexpensive to purchase, but reliable nevertheless.

A further object of the present invention is to so construct the packaging apparatus as to be capable of packaging goods of different shapes in a simple and inexpensive manner and in conformity with the shapes of the goods.

In pursuance of these objects and others which will become apparent hereafter, one feature of the present invention resides, briefly stated, in a method of packaging goods, such as flowers, flower pots, foodstuffs, beverages, and similar consumer goods, which method comprises the steps of superimposing two strip-shaped thermally weldable layers; converting the layers into an elongated formation having a receptable portion including a plurality of packaging receptacle preforms each having at least one open end, and at least one transporting portion extending along the receptacle portion and interconnecting the receptacle preforms in series, including applying heat to zones of the superimposed layers which extend from the open end of the respective receptacle preform into the receptacle portion and away from the transporting portion to thereby weld such zones of the layers to one another; advancing the transporting portion of the formation to thereby displace the receptacle preforms in a processing path; detaching the respective receptacle preform from the remainder of the receptacle portion of the formation at least at the welding zones; separating the superimposed layers of the detached receptacle preform at least at the open end thereof; introducing the goods to be packaged into the detached receptacle preform through the separated open end thereof; closing the open end of the filled receptacle preform; and dissociating the closed receptacle preform from the transporting portion to obtain a freely transportable filled receptacle. Advantageously, the superimposing step includes offsetting the layers relative to one another at least by the width of the transporting portion of the formation. The converting step may further include severing the layers at such regions thereof where the finished receptacle is to have openings. Preferably, the separation of the layers at the open end of the receptacle preform is accomplished by blowing a stream of a gaseous medium into the detached receptacle preform through the open end thereof. The advancing step may include guiding the transporting portion of the formation in a substantially horizontal orientation and allowing the detached receptacle preform to deviate downwardly from the horizontal orientation. Furthermore, the method may comprise the step of supporting and transporting the filled receptacle subsequent to the dissociating step, such as on an advancing conveyor belt or the like. The two layers may be constituted by different portions of the same strip-shaped foil or the like, but it is currently preferred to use two discrete foils each of which then constitutes one of the above-mentioned layers. The conversion of the foils or layers into the above-mentioned formation is accomplished upstream of the location at which the goods are filled into the respective receptacle preform as considered in the direction of displacement of the formation. So, for instance, the conversion may be accomplished at an installation completely separate from the actual filling arrangement and then the formation will be transported, for instance, wound on a core, from the installation at which it is manufactured to the installation at which the goods are to be packaged. However, it is also contemplated according to a currently preferred embodiment of the present invention to arrange the manufacturing installation immediately upstream of the filling installation, as a separate building unit, or even to incorporate the manufacturing installation into the filling apparatus upstream of the actual filling location.

The apparatus for performing the above-discussed method comprises, according to a further concept of the present invention, means for supplying two strip-shaped thermally weldable layers; means for superimposing the two layers; means for converting the layers into an elongated formation having a receptacle portion including a plurality of packaging receptacle preforms each having at least one open end, and at least one transporting portion extending along the receptacle portion and interconnecting the receptacle preforms in series, including means for welding the superimposed layers to one another at such zones of the receptacle portion which extend from the open end of the respective receptacle preform away from the transporting portion; means engaging the transporting portion of the formation and operative for advancing the same to thereby displace the receptacle preforms in a processing path; means for detaching the respective receptacle preform from the remainder of the receptacle portion of the formation at least at the welding zones of the latter; means located downstream of the detaching means and operative for separating the superimposed layers of the detached preform at least at the open end thereof; means for introducing the goods to be packaged into the detached receptacle preform through the separated open end thereof; means for closing the open end of the filled receptacle preform; and means for dissociating the closed receptacle preform from the transporting portion of the formation to thereby obtain a freely transportable filled receptacle. Advantageously, the introducing means includes a conveyor terminating at the open end of the receptacle preform in an introducing position of the latter.

The advancing means advantageously includes at least two engaging members confining the transporting portion of the formation between themselves, and means for driving at least one of the engaging members. The apparatus further includes means for supporting and transporting the filled receptacle which is located at least at and downstream along the processing path from the dissociating means. Preferably, the transporting means includes at least one conveyor belt which may extend underneath the separating means. The speed at which the transporting means moves advantageously substantially equals the speed at which the advancing means advances the formation.

When the apparatus is constructed in the above-discussed manner, the advancing means displaces the receptacle preforms in an upright orientation. Then, there may be provided means for changing the orientation of the receptacle preforms to substantially horizontal downstream of the introducing means and at the transporting means. Such changing means may include a support surface which commences substantially vertically and terminates substantially horizontally as considered in the direction of movement of the transporting means and along which the filled receptacle slides onto the transporting means. In an advantageous embodiment of the apparatus of the present invention, the introducing means includes means for blowing a stream of a gaseous medium into the detached receptacle through the open end thereof.

The respective receptacle may have another open end opposite to the above-mentioned one open end and permitting parts of the goods to emerge from the interior to the exterior of the receptacle preform. Then, the apparatus may further include means for supporting the emerging parts of the goods subsequent to the introduction thereof into the receptacle preform and during the displacement of the filled receptacle preform in the processing path, thus preventing the goods from leaving the interior of the receptacle through the other open end.

As already mentioned above, the formation which includes the transporting portion or strip and the plurality of receptacle preforms constituting the receptacle portion of the formation is obtained by resorting to welding operations which may simultaneously be used for separating the receptacle preforms from one another along the welding zones. In a currently preferred advantageous embodiment of the present invention, the converting means, whether incorporated in the filling apparatus or in a separate and independent manufacturing unit, includes at least one welding roller operative for welding the superimposed layers to one another at predetermined zones of the receptacle portion of the formation. The welding arrangement may further comprise means for severing the respective receptacle from the remainder of the receptacle portion of the formation at least at the welded zones thereof, provided that the severing operation is not directly performed by the welding roller. The operation of the severing means may be controlled in dependence on the position of the welding roller, such as by an eccentric portion of the welding roller which is in a permanent contact with a displaceable portion of the severing means.

The utilization of the above-mentioned welding roller brings about an important advantage in that the welding operation can be performed in a continuous manner without stopping the advancement of the two superimposed layers which are to be welded to one another at the welding zone, and without any reduction in the advancement speed of such superimposed layers. This is attributable to the fact that the welding roller can be rotated at a speed which is commensurate to the advancement speed of the superimposed layers so that the welding operation can be performed in its entirety during the continuous advancement of the two superimposed layers. Thus, the welding operation may be performed without any interruption in the advancement of the two superimposed layers, actually, during the normal advancement of such layers.

In a currently preferred advantageous embodiment of the welding roller of the present invention, the welding roller includes at least one electrically insulating portion, and at least one electrically resistive conductor wire which is mounted on the insulating portion. The conductor wire, which is mounted on the welding roller for rotation therewith at a speed which is commensurate to the advancement speed of the superimposed layers is brought to a temperature of, for instance, between 100° and 150° C., to give an example, by passing electric current therethrough. It is to be understood that the exact temperature or temperature range of the conductor wire will depend on the properties of the materials of the layers to be welded together, particularly their melting or softening temperatures. Thus, the above-mentioned temperature range is only an exemplary range. Of course, the wire should be of a material which is wear-resistant and is capable of withstanding many thousands of welding operations. In actual practice, excellent results have been obtained by using a wire of chromium-nickel steel, the wire having a diameter of about 1 mm. However, here again, the selection of the material of the wire and the dimensions thereof will depend on the material to be thermally welded.

The conductor wire extends on the welding roller along a course which, when developed into a plane, coincides with the predetermined zones to be welded. In order to weld only at the desired welding zones, the conductor wire has portions which are located at the periphery of the welding roller which coincide, when developed into a plane, with the predetermined zones to be welded, the conductor wire also having other portions which are accommodated within the welding roller and thus incapable of performing any welding operations. Of course, the course along which the conductor wire extends on the welding roller will depend on the desired shape of the final receptacle. So, for instance, for a rectangular receptacle, the conductor wire will extend axially and transversely of the periphery of the welding roller, while the conductor wire will be helically wound about the periphery of the welding roller when it is desired to manufacture receptacles which converge toward one of their ends. In a currently preferred embodiment of the present invention, the welding roller, which may be made of an electrically insulating material, has at least one groove. Then, the insulating portion may be a separate electrically insulating member detachably accommodated in the groove. The conductor wire itself, or the separate electrically insulating member may be yieldably mounted on the welding roller.

It is currently preferred to arrange at least one supporting element across the superimposed layers from the welding roller. Advantageously, the supporting element is a counter roller.

Finally, the present invention is related to a novel article of manufacture, that is, a packaging receptacle for packaging goods which is obtained by the method and with resort to the apparatus disclosed above, which packaging receptacle comprises two thermally weldable superimposed layers which are welded to one another at welding zones leaving at least one open end therebetween. Advantageously, the welding zones and the open end are so arranged as to permit the introduction of the goods into the receptacle and as to give the receptacle a shape substantially conforming to the configuration of the goods to be packaged therein.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 2*a* is a side elevational view of a welding roller according to the present invention which is to be used in the arrangement of FIG. 1*a.

DETAILED DISCUSSION OF THE PREFERRED EMBODIMENTS

Figure 1:
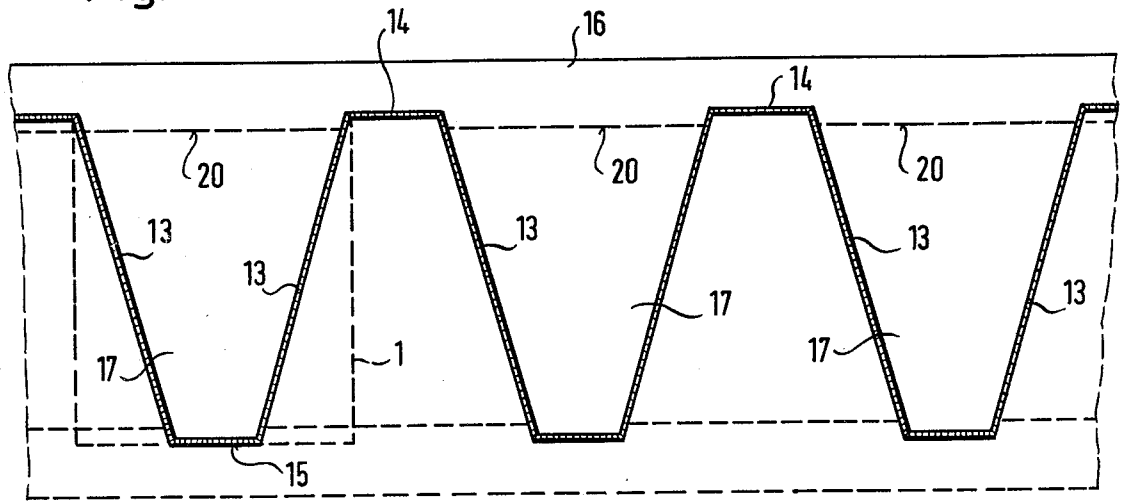
FIG. 1 is a top plan view of a double-layer structure for manufacturing packaging receptacles therefrom, indicating the shapes of rectangular and trapezoidal receptacles.
Figure 2:
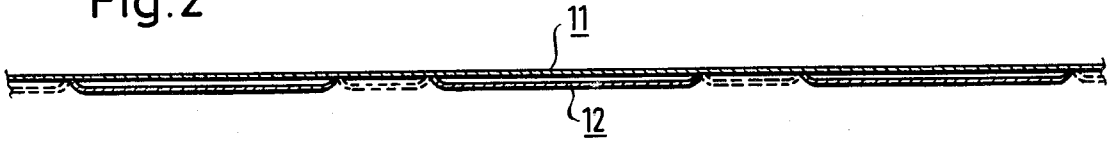
FIG. 2 is a longitudinal section through the structure of FIG. 1.

Referring now to the drawing in detail, and first to FIGS. 1 and 2, it may be seen therein that, for instance, two foils 11 and 12 are juxtaposed with one another, and connected to each other by resorting, for instance, to thermal welding so that bags or similar packaging receptacles are obtained. As particularly apparent in FIG. 1, the individual receptacles are delimited by welding zones 13, 14 and 15. Thus, in this illustrated embodiment, the receptacles are closed bags which have a filling opening at one end of each of the receptacles. The receptacles illustrated in solid lines in FIG. 1 have trapezoidal configurations; however, as indicated in broken lines in FIG. 1, the receptacles could also have rectangular configurations. These contours of the receptacles are exemplary only, the configurations of the receptacles being dependent on the shapes of the goods to be accommodated therein in such a manner that the amount of waste material of the foils or strips 11 and 12 be kept to a minimum. When the welding operation is terminated, there is obtained a plurality of separate receptacles 17.

Figure 3A:
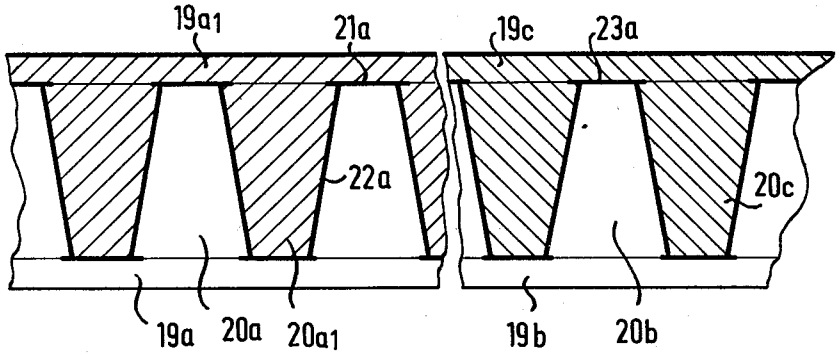
* and FIG. 3*a* is a top plan view of a formation obtained in the arrangement of FIG. 1*a* and including a plurality of the receptacles of the present invention.
Figure 3:
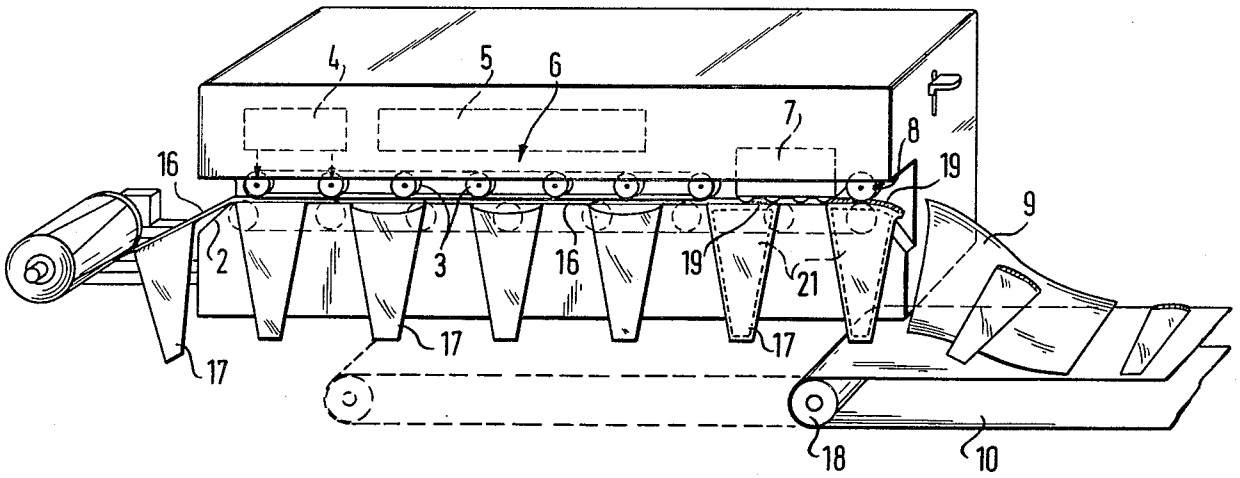
FIG. 3 is a somewhat diagrammatic side elevational view of an apparatus according to the present invention.

The formation illustrated in FIGS. 1 and 2 is, according to the present invention, manufactured either directly in or at the filling apparatus, or in a manufacturing installation which is located remotely from the actual filling apparatus. This latter possibility is illustrated in FIG. 3 which, at the left-hand side, shows a premanufactured roll of a strip corresponding to that of FIGS. 1 and 2 which includes a transporting portion 16 interconnecting the individual receptacle preforms 17. These receptacles 17 are also welded at their bottom ends so that receptacles 17 are ready for accommodating the goods. While the roll of the strip has been illustrated as having a horizontal orientation, it will be appreciated that it can assume any other orientation, for instance, a vertical orientation.

The transporting portion 16 is engaged by engaging means of a conventional construction, such as the illustrated endless conveyor belts trained about a plurality of rollers 3. However, the transporting portion 16 could also be directly engaged by the rollers 3, the endless conveyor belts being omitted under these circumstances. It would also be sufficient if only a guiding surface were arranged underneath the path of displacement of the transporting portion 16, in which event the rollers 3 would be arranged only upwardly of the path of movement of the transporting portion 16 and engage the same for advancing the transporting portion 16 and with it also the receptacles 17 in the processing direction.

FIG. 3 also illustrates, in a schematic manner, a conventional welding arrangement 4. While this welding arrangement 4 has been illustrated as being located upwardly of the path of displacement of the transporting portion 16, it will, in reality, be located underneath the path of displacement of the transporting portion 16 inasmuch as it serves the purpose of welding the originally open lower ends of the receptacles 17, in the event that such lower ends are not already welded. However, this welding arrangement 4 could be arranged upstream of the actual filling apparatus illustrated in FIG. 3, unless the receptacles 17 are already delivered with the bottom ends thereof closed, or unless it is desired to leave the lower ends of the receptacles 17 open, in which event the welding arrangement 4 can be omitted.

FIG. 3 further illustrates a blower 5, such as a cross-flow blower which serves to separate the open upper end of the respective receptacle 17. Downstream of the blower 5, there is arranged a filling location 6. When the apparatus illustrated in FIG. 3 is a semi-automatic machine, the goods will be introduced into the receptacles 17 through the open end thereof in a manual manner. However, it is also contemplated by the present invention to arrange a conveyor at the filling location 6, which can extend in any direction relative to the apparatus of FIG. 3 depending on the trajectory along which the goods are to be transported thereby, the conveyor terminating at the filling location 6 and delivering the goods to the previously separated open end of the respective receptacle 17 which is then located at the filling location 6. A further welding arrangement 7 is arranged downstream of the filling location 6 and serves the purpose of closing the open end of the receptacle 17 after the goods have been introduced thereinto. The goods accommodated in the receptacles 17 have been indicated with the reference numeral 21. Thereafter, the receptacle 17 containing the goods 21 is severed, in a known manner, from the remainder of the formation which passes through the apparatus of FIG. 3.

When the goods 21 are bulky or heavy, or even under other circumstances, it is proposed by the present invention to arrange a guiding member 9 downstream of the welding arrangement 7 which reorients the filled receptacles 17 severed from the remainder of the formation from their originally assumed substantially vertical position into a substantially horizontal position on a conveyor belt 10. The severed receptacles 17 slide along a sliding surface of the member 9, thus being reoriented. However, while the member 9 has been illustrated as a sheet-metal member, it is also conceivable and contemplated by the present invention to provide an additional conveyor belt having a shape similar to that of the member 9, or to have the conveyor belt 10 extend in the curved manner of the member 9 at its upstream end. As illustrated, the conveyor belt 10 is trained about a roller 18 which is arranged somewhat to the left from the downstream end of the apparatus illustrated in FIG. 3. The conveyor belt 10 is arranged at such an elevation that the bottom ends of the receptacles 17 are located immediately above or are in contact with the conveyor belt 10.

The conveyor belt 10 is only one example of the transporting means which could be used in the environment of the present invention. Also, as illustrated in FIG. 3, the conveyor belt could extend all the way underneath the blowing arrangement 5 beyond the filling location 6, as illustrated in dashed lines. This is particularly recommended when the goods 21 are heavy, under which circumstances the bottom portion of the receptacles 17 can rest on and be supported by the conveyor belt 10 during the filling thereof with the heavy goods 21. Advantageously, the conveyor belt 10 advances at the same speed as the formation including the transporting portion 16 and the series of receptacles 17. However, the speeds of advancement could also differ from one another, if so desired.

A non-illustrated possibility, which could be accomplished by resorting to a member similar to the member 9, is to reorient the receptacle 17 at the location 4.

Referring now again to FIGS. 1 and 2, it may be seen therein that, as illustrated, the two layers which are to be welded to one another are two separate foils 11,12. However, it is also contemplated to obtain the structure of FIGS. 1 and 2 by folding a strip of the packaging material lengthwise, substantially in the central region thereof. An advantage of this embodiment is that the layers 11 and 12 need only be welded at two sides thereof and, subsequent to the filling, at the originally open end thereof. Under these circumstances, the bottom of the receptacles 17 is closed to begin with.

When the receptacles 17 are trapezoidal and at a distance from one another, the material intermediate the receptacles 17 can also be used as further receptacles.

The apparatus of FIG. 3 may be of such dimensions as to be supportable on a desk or on a counter, or it may be equipped, in a conventional manner, with rollers or the like to permit the transportation of this apparatus from one location to another. It may be seen from the above discussion that the apparatus of FIG. 3 is capable of utilizing pre-manufactured rolls of the above-discussed formations including the receptacles 17, which are manufactured in an arrangement which will be discussed subsequently. The apparatus of FIG. 3 permits continuous transport of the formation and the separation of the open end of the respective receptacle 17 in order to be able to introduce the goods to be packaged into the receptacle 17, as well as to sever the final receptacles 17 filled with the goods 21 from the transporting portion 16. Thus, the apparatus of FIG. 3 can be utilized for semi-automatic packaging or filling of goods.

Figure 1A:
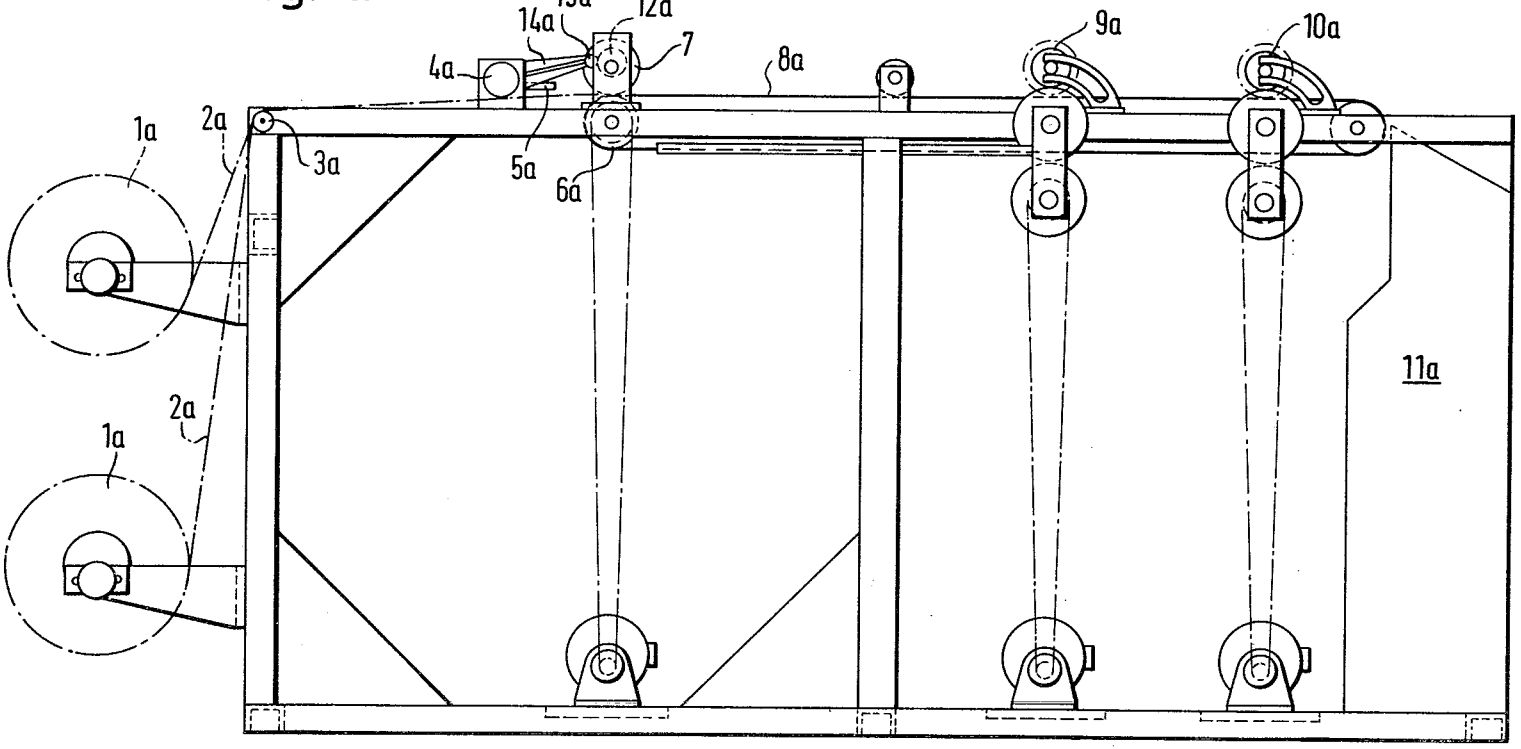
FIG. 1*a* is a diagrammatic side elevational view of an arrangement of the present invention for manufacturing the receptacle.

Referring now to FIG. 1*a*, it may be seen therein that, on the left hand thereof, there are provided rollers 1*a* which are mounted in a conventional manner. Foils 2*a* of desirably strong synthetic plastic material are provided on the rollers 1*a*. The foils 2*a* are separately guided toward a welding arrangement which will be discussed in more detail later on, preferably in an offset relationship with respect to one another in the event that it is desired to manufacture the receptacles which appear in the later-discussed FIG. 3*a*.

FIG. 1*a* further illustrates a guiding roller 3*a* from which point the two foils 2*a* are superimposed with one another and are jointly guided toward a welding roller 7*a* with which there is juxtaposed a support roller 6*a*. In the illustrated embodiment, an endless band 8*a* is trained about the support roller 6*a*, the band 8*a* being further trained about another roller at the other end for return movement. The driving and mounting arrangements which are associated with the band 8*a* are of conventional constructions and need no detailed discussion herein. Furthermore, there are provided take-up reels 9*a* and 10*a* which are also conventional and need not be discussed. Suffice it to say that the take-up reel 9*a* accepts, for instance, a formation $20a_1$ or 20*c* shown in FIG. 3*a*, and, similarly, the take-up reel 10*a* accepts the formation 20*a* or 20*b*.

The welding roller 7*a* which will be discussed later on is supported in a conventional manner. An eccentric disk 12*a* or a similar eccentric arrangement is associated with the welding roller 7*a*. A follower roller 13*a* presses against the eccentric disk 12*a*, the roller 13*a* being mounted on a lever arm 14*a*. The lever arm 14*a* is supported on a shaft 4*a*. Also, a cutting blade 5*a* is mounted on the shaft 4*a* for joint pivoting therewith in accordance with the pivotal displacement of the lever arm 14*a*. Thus, as the eccentric disk 14*a* rotates, the lever arm 14*a* conducts angular movements about the shaft 4*a*, and such angular movements are transmitted by the shaft 4*a* to the cutting blade 5*a*. Thus, when the cutting blade 5*a* is moved in the clockwise direction as illustrated in FIG. 1*a*, it will eventually contact and cut through the superimposed layers 2*a*. On the other hand, when the cutting blade 5*a* is displaced in the counterclockwise direction, it will eventually dissociate itself from the foils 2*a*, thus terminating the cutting operation.

Instead of the illustrated and described cutting blade 5a, there could be used, in a similar manner, a further welding arrangement, the welding arrangement performing welding operations instead of the above-discussed cutting operations, in the same sequence as discussed above.

Also, the elongated cutting blade 5a or the similarly configurated further welding arrangement could be replaced by rotating driven disks, also of conventional constructions. Such disk-shaped cutting or welding arrangements are well known and usually they converge towards their peripheries to form a sharp edge thereat.

In the embodiment illustrated in FIG. 1a, the rotation of the support roller 6a is accomplished by a conventional motor which is arranged downwardly of the roller 6a. The welding roller 7a may be driven in rotation by the friction between itself and the upper foil 2a; however, the welding roller 7a could also be driven in rotation by a non-illustrated conventional drive.

Figure 2A:
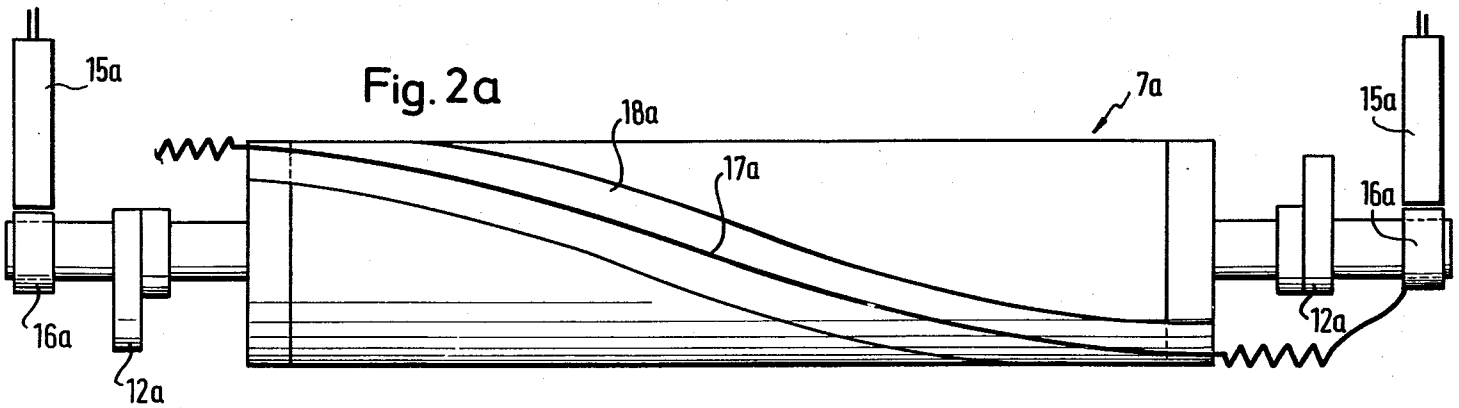

The welding roller 7a is illustrated in more detail in FIG. 2a. As illustrated, the welding roller 7a is of a cylindrical configuration, but it should be understood that the roller 7a could have any desired configuration, such as, for instance, elliptical. The welding roller 7a may consist of an electrically insulating material. In addition thereto, there is provided a further insulation 18a on which a welding electrically resistant conductor wire 17a is mounted. The conductor wire 17a, in the illustrated embodiment, extends along a helical course about the periphery of the welding roller 7a so that, when the welding roller 7a is rotated, there is obtained the trapezoidal configuration of the respective receptacle as illustrated in FIG. 3a.

The conductor wire 17a performs two functions. On the one hand, it performs the welding function and, on the other hand, it separates the individual receptacles from one another so that, as illustrated in FIG. 3a, there are obtained, without any loss of the packaging material, packaging containers 20a and 20a$_1$, or 20b and 20c.

As a result of the fact that the foils 2a travel along somewhat offset paths, there are obtained single-layer transport portions 19a to 19c. However, if the strength of the material of the foil 2a is insufficient, the transporting portions 19a to 19c could be reinforced by attaching a further strip, which is not illustrated, to the transporting portions 19a to 19c.

The lines 21a represent cuts which, advantageously, extend across the line 22a which is the actual welding zone. Under these circumstances, it is quite easy to separate layers 2a at the open end of the receptacle in that the two layers of the foils 2a no longer positively adhere to one another. These cuts 21a are made by the cutting blade 5a which is operated in a predetermined sequence with operation of the welding roller 7a as a result of the provision of the eccentric disk 12a.

At the right-hand side of FIG. 3a, the line 23a does not represent a cut; rather, it indicates a welding zone. Under these circumstances, a further welding arrangement has been used instead of the above-discussed cutting blade 9a, the welding arrangement having preferably the shape of a roller. However, it is to be understood that such a welding zone could also be produced by a properly oriented further conductor wire which has not been illustrated, or by appropriately shaping the conductor wire 17a.

The conductor wire 17a could also extend parallel to the axis of the welding roller 7a or have another inclined or curved configuration. The course along which the conductor wire 17a will extend will depend on the desired shape of the receptacle to be manufactured.

In the illustrated embodiment, the conductor wire 17a is mounted on the welding roller 7a by means of an insulating member 18a. However, the conductor wire 17a could also be mounted on a non-illustrated conventional insulating block, and the entire insulating block could then be accommodated in a correspondingly configurated groove of the welding roller 7a and connected to the latter, for instance, by screws.

It is further contemplated by the present invention to mount the conductor wire 17a on a somewhat yieldable support member in order to provide for a corresponding pressure-equalization.

An important aspect of the present invention resides in the fact that control means are mounted on the welding roller 7a which control the displacement of the above-discussed cutting blade 5a or the additional welding arrangement. In the illustrated example, the control function is performed by the eccentric disk 12a seen in FIG. 2a. As further illustrated therein, a commutator ring 16a is mounted on the end portion of a shaft of the welding roller 7a; a lead extends from the commutator ring 16a to the conductor wire 17a, through which the electric current which is needed for heating the conductor wire 17a passes. The electric current is delivered to the commutator ring 16a from, for instance, a transformer, by a commutator brush 15a.

Under some circumstances, for instance, when a bunch of flowers or a bouquet is to be packaged, it may be desirable to let the stems of the flowers protrude from the wrapper or receptacle to a certain extent. When this is desired, then the receptacles 20a$_1$ illustrated in the left half of FIG. 3a are used in the apparatus of FIG. 3, that is, receptacles 20a$_1$ which have open lower ends established by the cuts 21a. In this situation, it may be desirable to support the ends of the stems of the flowers from below so as not to let the flowers protrude from the receptacle 20a$_1$ or 17 to an undesirably large extent or fall out of the receptacle 20a$_1$ or 17 through the open lower end thereof altogether. Thus, for instance, the conveyor belt 10 illustrated in FIG. 3 can extend at least underneath the filling location 6 as illustrated in FIG. 3 in dashed lines. However, it is also conceivable and proposed by the present invention to arrange a different belt conveyor underneath the filling location, extending toward the belt conveyor 10, or to provide a stationary support member, such as a support plate, underneath the filling location 6 and extending toward the belt conveyor 10. This support arrangement may be mounted for adjustment of its elevation in order to be able to control the extent to which the stems of the flowers or other parts of different goods will protrude downwardly beyond the open end of the receptacle 17.

It will be appreciated that the above discussion reveals only the basic concepts of the present invention and that, depending on the circumstances and the particular results to be achieved, the packaging apparatus and the welding arrangement could be modified in various ways. So, for instance, the advancing arrangement 3 illustrated in FIG. 3 could be provided with adherent or friction-enhancing means in order to avoid, to the greatest extent possible, the otherwise possible slippage between the advancing means 3 and the transporting strip 16. Also, the belt conveyor 10 could be adjustable as to its elevation as well as to its inclination so that the belt conveyor 10 need not necessarily extend horizontally, in contradistinction to what is illustrated in FIG. 3. Furthermore, as already mentioned above, the support member 9 need not necessarily be configurated as the illustrated sheet-metal member, but rather it could be a belt conveyor, a portion of the belt conveyor 10, a series of rollers or a similar arrangement capable of supporting the filled receptacle 17 during its reorientation from a substantially vertical to a substantially horizontal position. Additionally, the supply roll of the formation 16 and 17 illustrated at the left hand end of FIG. 3 could assume any advantageous orientation in addition to the illustrated horizontal orientation.

As also already mentioned above, the way in which the welding wire 17*a* is supported on the welding roller 7*a* via the insulating member 18*a* is only exemplary and, in fact, the welding wire 17*a* could be supported on the welding roller 7*a* in any other way, either directly or indirectly. The welding wire 17*a* could also extend along a different course from that illustrated in FIG. 2*a*, such as parallel to the axis of the welding roller 7*a*, at an inclination to such axis, along an arcuate path, and so on, depending on the shape of the receptacle to be manufactured. The welding conductor wire 17*a* could have any desired cross-sectional shape, such as circular, polygonal, oval and so on.

The welding roller 7*a* and the counter roller 6*a* illustrated in FIG. 1 could have the same circumferential speeds, but they could also have different circumferential speeds, depending on the results to be obtained. Also, while the welding roller 7*a* and the counter roller 6*a* have been illustrated as extending normal to the elongation of the foils 2*a*, it is to be understood that either one of these rollers 7*a* and 6*a*, or both of them, could have their axes extending at an angle different from a right angle to the elongation of the foils 2*a*. Also, the axes of the rollers 7*a* and 6*a* could be other than parallel to one another.

It will be understood that, unless the wire 17*a* is mounted on the welding roller 7*a* of FIG. 2*a* in an axially parallel manner, the wire 17*a* will come into contact with the foils 2*a* in a gradual manner, that is, the region of contact of the wire 17*a* with the upper foil 2*a* will shift longitudinally of the wire 17*a* during the rotation of the welding roller 7*a* and during the advancement of the foils 2*a*. This renders it possible to achieve an excellent quality of the weld during the continuous advancement of the foils 2*a*.

It will also be realized that the cutting blade 5*a* could be replaced by a cutting disk of a conventional construction, or a welding bar or a welding disk also of a conventional construction, when so desired. Also, the upward and downward movement of the cutting blade 5*a* or its replacement could be controlled in dependence on the rotation of the welding roller 7*a* in any other manner than by the eccentric disk 12*a* illustrated in FIG. 2*a* such as, for instance, by a crank, so long as it is assured that the movement of the cutting blade 5*a* or its replacement is tied to the rotation of the welding roller 7*a*. Also, the shape of the disk 12*a* could be different from circular, whereby the speed of displacement of cutting blade 5*a* or its replacement and the timing, but not the sequence, of the movement, could be controlled. Furthermore, the lever 14*a* and the associated follower roller 13*a* could be substituted by a different motion-transmitting arrangement.

The present invention renders it possible to precisely select the final shape of the receptacle 17, 20*a*, 20$a_1$, 20*b* or 20*c* by appropriately arranging the welding wire 17*a* on the welding roller 7*a*. So, for instance, the receptacle 17 could have a polygonal, round, oval or other shape instead of the illustrated trapezoidal form and the indicated rectangular form.

Moreover, a guiding plate, a series of rollers or any other conveying arrangement could be used instead of the illustrated belt conveyor 10, so long as it is assured that this transporting arrangement is capable of supporting and transporting the filled containers 17 of FIG. 3. Also, when it is not desired to transport the filled container 17 to a distant location, that is, when the user of the filling arrangement gets hold of the filled container 17 as it emerges from the filling arrangement, the conveyor 10 could be omitted altogether.

It will be understood that each of the elements described above, or two or more together, may also find a useful application in other types of constructions differing from the types described above.

While the invention has been illustrated and described as embodied in an arrangement for manufacturing packaging receptacles and an apparatus for filling such receptacles with consumer goods, such as flowers, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of packaging goods, such as flowers, flower pots, foodstuffs, beverages, and similar consumer goods, comprising the steps of superimposing two strip-shaped thermally weldable layers; converting the layers into an elongated formation having a receptacle portion including a plurality of packaging receptacle preforms each having at least one open end, and at least one transporting portion extending along the receptacle portion and interconnecting the receptacle preforms in series, including applying heat to zones of the superimposed layers which extend from the open end of the respective receptacle preform into the receptacle portion and away from the transporting portion to thereby weld such zones of the layers to one another; advancing the transporting portion of the formation to thereby displace the receptacle preforms in a processing path; detecting the respective receptacle preform from the remainder of the receptacle portion of the formation at least at the welded zones; separating the superimposed layers of the detached receptacle preform at least at the open end thereof; introducing the goods to be packaged into the detached receptacle preform through the separated open end thereof; closing the open end of the filled receptacle preform; dissociating the closed receptacle preform from the transporting portion after said closing step, to obtain a freely transportable filled receptacle; supporting and transporting the filled receptacle preform which is dissociated from the transporting portion, by movable means; and using said movable means which supports and transports the dissociated filled receptacle preform, during said introducing step for supporting the receptacle preform.

2. A method as defined in claim 1, wherein said superimposing step includes offsetting the layers relative to one another at least by the width of the transporting portion of the formation.

3. A method as defined in claim 1, wherein said converting step further includes severing the layers at such regions thereof where the receptacle preforms are to have the one open end.

4. A method as defined in claim 1, wherein said separating step includes blowing a stream of a gaseous medium into the deteached receptacle preform through the open end thereof.

5. A method as defined in claim 1, wherein said advancing step includes guiding the transporting portion of the formation in a substantially horizontal orientation and allowing the detached receptacle preform to deviate downwardly from the horizontal orientation.

6. A method as defined in claim 1, and further comprising the step of further advancing the filled receptacle from a first location wherein said introducing step is performed to a second location wherein said dissociation step is performed, said using step including using said movable means for supporting the filled receptacle preform during said further advancing step between said first and second locations.

7. An apparatus for packaging goods, such as flowers, flower pots, foodstuffs, beverages, and similar consumer goods, comprising means for supplying two strip-shaped thermally weldable layers; means for superimposing the two layers; means for converting the layers into an elongated formation having a receptacle portion including a plurality of packaging receptacle preforms each having at least one open end, and at least one transporting portion extending along the receptacle portion and interconnecting the receptacle preforms in series, including means for welding the superimposed layers to one another at zones of the receptacle portion which extend from the open end of the respective receptacle preform away from the transporting portion; means engaging said transporting portion of the formation and operative for advancing the same to thereby displace the receptacle preforms in a processing path; means for detaching the respective receptacle preform from the remainder of the receptacle portions of the formation at least at the welded zones of the latter; means located downstream of said detaching means and operative for separating the superimposed layers of the detached receptacle preform at least at the open end thereof; means for introducing the goods to be packaged into the detached receptacle preform through the separated open end thereof; means for closing the open end of the filled receptacle preform; means for dissociating the closed receptacle preform from the transporting portion of the formation to thereby obtain a freely transportable filled receptacle; and movable means for supporting and transporting the filled receptacle preform which is dissociated from the transporting portion, and for simultaneously supporting the receptacle preform during introducing the goods thereinto.

8. An apparatus as defined in claim 7, wherein said introducing means includes a conveyor terminating at the open end of the receptacle preform in an introducing position thereof.

9. An apparatus as defined in claim 7, wherein said advancing means includes at least two engaging members confining the transporting portion of the formation between themselves, and means for driving at least one of said engaging members.

10. An arrangement as defined in claim 7, wherein said movable means extends underneath as well as at least at and downstream said dissociating means, and underneath as well as at least at and downstream said introducing means.

11. An apparatus as defined in claim 7, wherein said movable means includes at least one conveyor belt.

12. An arrangement as defined in claim 10, wherein said advancing means has a portion operative for advancing the receptacle preform between said introducing means and said dissociating means, said movable means being located also underneath said portion of said advancing means.

13. An apparatus as defined in claim 7, wherein said movable means moves at a speed which substantially equals that of said advancing means.

14. An apparatus as defined in claim 7, wherein said advancing means displaces the receptacle preforms in an upright orientation; and further comprising means for changing the orientation of the receptacle preforms to substantially horizontal downstream of said introducing means and at said movable means.

15. An apparatus as defined in claim 14, wherein said changing means includes a support surface which commences substantially vertically and terminates substantially horizontally as considered in the direction of movement of the movable means and along which the filled receptacle slides onto said movable means.

16. An apparatus as defined in claim 7, wherein said introducing means includes means for blowing a stream of a gaseous medium into the detached receptacle through the open end thereof.

17. An apparatus as defined in claim 7, wherein the respective receptacle has another open end opposite said one open end and permitting parts of the goods to emerge from the interior to the exterior of the receptacle preform; and further comprising means for supporting the emerging parts of the goods subsequent to the introduction thereof into the receptacle preform and during the displacement of the filled receptacle preform in the processing path, thus preventing the goods from leaving the interior of the receptacle through said other open end.

* * * * *